US008919250B2

(12) United States Patent
Sakash et al.

(10) Patent No.: US 8,919,250 B2
(45) Date of Patent: Dec. 30, 2014

(54) PRINTING PRESS AND METHOD FOR POSITIONING CYLINDERS THEREIN

(75) Inventors: Aaron Christian Sakash, Somersworth, NH (US); Atef Tanious Massoud, Nottingham, NH (US); Gerald Louis Bosey, Rochester, NH (US)

(73) Assignee: Goss International Americas, Inc., Durham, NH (US)

( * ) Notice: Subject to any disclaimer, the term of this patent is extended or adjusted under 35 U.S.C. 154(b) by 568 days.

(21) Appl. No.: 12/848,518

(22) Filed: Aug. 2, 2010

(65) Prior Publication Data

US 2012/0024174 A1 Feb. 2, 2012

(51) Int. Cl.

| | |
|---|---|
| ***B41F 7/04*** | (2006.01) |
| ***B41F 13/40*** | (2006.01) |
| ***B41F 13/38*** | (2006.01) |
| ***B41F 33/00*** | (2006.01) |
| ***B41F 33/02*** | (2006.01) |

(52) U.S. Cl.

CPC . *B41F 13/40* (2013.01); *B41F 7/04* (2013.01); *B41F 13/38* (2013.01); *B41F 33/00* (2013.01); *B41F 33/02* (2013.01)

USPC ..... 101/137; 101/139; 101/140; 101/143; 101/144; 101/145

(58) Field of Classification Search

USPC ..... 101/139, 137, 218, 143, 144

See application file for complete search history.

(56) References Cited

U.S. PATENT DOCUMENTS

| | | | | |
|---|---|---|---|---|
| 5,448,949 | A * | 9/1995 | Bucher | 101/216 |
| 5,787,808 | A * | 8/1998 | Stram et al. | 101/216 |
| 5,806,427 | A | 9/1998 | Niemiro et al. | |
| 5,813,336 | A | 9/1998 | Guaraldi et al. | |
| 5,868,071 | A | 2/1999 | Niemiro et al. | |
| 6,227,111 | B1 * | 5/2001 | Dawley et al. | 101/218 |
| 6,272,986 | B1 * | 8/2001 | Hess | 101/137 |
| 6,408,748 | B1 * | 6/2002 | Hajek et al. | 101/177 |
| 6,634,297 | B2 * | 10/2003 | Poetter et al. | 101/484 |
| 6,694,877 | B1 | 2/2004 | Wolters et al. | |
| 7,765,930 | B2 * | 8/2010 | Schneider et al. | 101/485 |
| 2002/0078844 | A1 * | 6/2002 | Dilling | 101/247 |
| 2002/0189469 | A1 * | 12/2002 | Gilliam et al. | 101/213 |
| 2003/0005840 | A1 * | 1/2003 | Poetter et al. | 101/483 |
| 2005/0072328 | A1 * | 4/2005 | Gilliam et al. | 101/247 |
| 2007/0039493 | A1 * | 2/2007 | Metrope | 101/218 |
| 2007/0039494 | A1 * | 2/2007 | Chrigui | 101/218 |
| 2007/0157832 | A1 * | 7/2007 | Menu et al. | 101/218 |
| 2007/0221075 | A1 | 9/2007 | Kundgen et al. | |
| 2008/0141886 | A1 * | 6/2008 | Whitelaw et al. | 101/484 |
| 2008/0148974 | A1 * | 6/2008 | Hugel et al. | 101/248 |
| 2008/0216697 | A1 * | 9/2008 | Takenouchi et al. | 101/484 |
| 2009/0301330 | A1 * | 12/2009 | Noy | 101/484 |
| 2010/0126368 | A1 | 5/2010 | Zlatin et al. | |
| 2010/0288146 | A1 * | 11/2010 | Levanon et al. | 101/248 |

* cited by examiner

*Primary Examiner* — David Banh

(74) *Attorney, Agent, or Firm* — Davidson, Davidson & Kappel, LLC

(57) ABSTRACT

The present invention provides a printing press. The printing press includes a frame, a plate cylinder, a plate cylinder support supporting the plate cylinder, a blanket cylinder for receiving an image from the plate cylinder, a blanket cylinder support supporting the blanket cylinder, an impression cylinder for supporting a printing substrate between the blanket cylinder and the impression cylinder, an actuator connected to and controlling a position of the plate cylinder support or the blanket cylinder support and a controller providing the actuator with a position setpoint, the actuator receiving position feedback signals to maintain the position setpoint during a printing operation. The present invention also provides a method for operating a printing press.

20 Claims, 5 Drawing Sheets

PRINTING PRESS AND METHOD FOR POSITIONING CYLINDERS THEREIN

The present invention relates generally to printing presses, and more particularly to a printing press with a method for positioning the cylinders therein.

BACKGROUND INFORMATION

U.S. Pat. No. 5,868,071 discloses a variable cutoff printing press with blanket cylinders mounted on linear slide assemblies to accommodate blanket sleeves of different thicknesses.

U.S. Pat. No. 6,694,877 purports to disclose a device for use in an offset press, for permitting and positioning of at least a format-dependent printing cylinder individually exchangeable therein. A system with bearing arms positions the cylinders by rotation.

U.S. Pat. No. 5,806,427 discloses a rotary offset printing press having a pair of interchangeable plate cylinders mounted on a carriage.

U.S. Pat. No. 5,813,336 discloses a printing unit with a rotatable print cylinder and a rotatable blanket cylinder. A tubular printing blanket is removably mounted on the blanket cylinder. The printing unit may have an imaging unit mounted therein. A printing member, which is mountable on the print cylinder, is imaged by the imaging unit inside the printing unit. The printing member has a continuous surface and may be removed axially from the print cylinder. The printing unit may be configured as a cantilever printing unit, or, alternatively, may be configured with both a gear side frame and a work side frame for supporting the print and blanket cylinders. In order to provide a variable-cutoff capability, a plurality of print cylinder saddles may be provided. Each print cylinder saddle has the same inner diameter for mounting on the print cylinders. However, in order to provide a variable cut-off, the print cylinder saddles may have a variety of outer diameters.

U.S. Pat. Nos. 5,813,336, 5,806,427, 6,694,877 and 5,868,071 are hereby incorporated by reference herein.

SUMMARY OF THE INVENTION

The present invention provides a printing press. The printing press includes a frame, a plate cylinder, a plate cylinder support supporting the plate cylinder, a blanket cylinder for receiving an image from the plate cylinder, a blanket cylinder support supporting the blanket cylinder, an impression cylinder for supporting a printing substrate between the blanket cylinder and the impression cylinder, an actuator connected to and controlling a position of the plate cylinder support or the blanket cylinder support and a controller providing the actuator with a position setpoint, the actuator receiving position feedback signals to maintain the position setpoint during a printing operation.

The present invention also provides a variable format printing press that includes a frame, a plate cylinder, a plate cylinder support supporting the plate cylinder, a blanket cylinder for receiving an image from the plate cylinder, a blanket cylinder actuator connected to the blanket cylinder support, an impression cylinder for supporting a printing substrate between the blanket cylinder and the impression cylinder, an actuator connected to and controlling a position of the plate cylinder support or the blanket cylinder support and a controller providing the actuator with a first position setpoint corresponding to a first plate cylinder diameter and a second position setpoint corresponding to a second plate cylinder diameter, the actuator receiving feedback signals to maintain either the first setpoint position or the second setpoint position during a printing operation.

The present invention also provides a method for operating a printing press. The method includes setting a position of a plate cylinder or a blanket cylinder in a printing press via an actuator to a cylinder position setpoint, receiving position feedback information and actively controlling the actuator during a printing operation to maintain the cylinder position setpoint.

BRIEF DESCRIPTION OF THE DRAWINGS

The present invention will be described with respect to preferred embodiments, in which.

DETAILED DESCRIPTION

Previous printing presses, such as prior art variable format printing presses, have allowed for positioning of cylinders using actuators. However, these actuators generally have been passive, in that they are set to a specific position for example for a certain format size and thereafter are not changed. They thus do not react or correct to compensate for variations induced by many factors. These factors may include mechanical vibrations, temperature and humidity fluctuations, and wear over time from normal operations. In particular, the printing press described in U.S. Pat. No. 6,694,877 describes a mechanical ball screw actuator that may not perform well when the screw carries a load in a fixed position for an extended period of time.

The present invention can provide for active control of the cylinders in the printing press during operation via position feedback. Proper squeeze settings and positioning can be ensured, even as conditions change during printing. Moreover, the present invention has particular advantages with respect to variable format printing presses, in that the position changes required for the variable format cylinders can be easily and quickly achieved. No size-specific components other than replaceable sleeves or cylinders are required.

Figure 1:
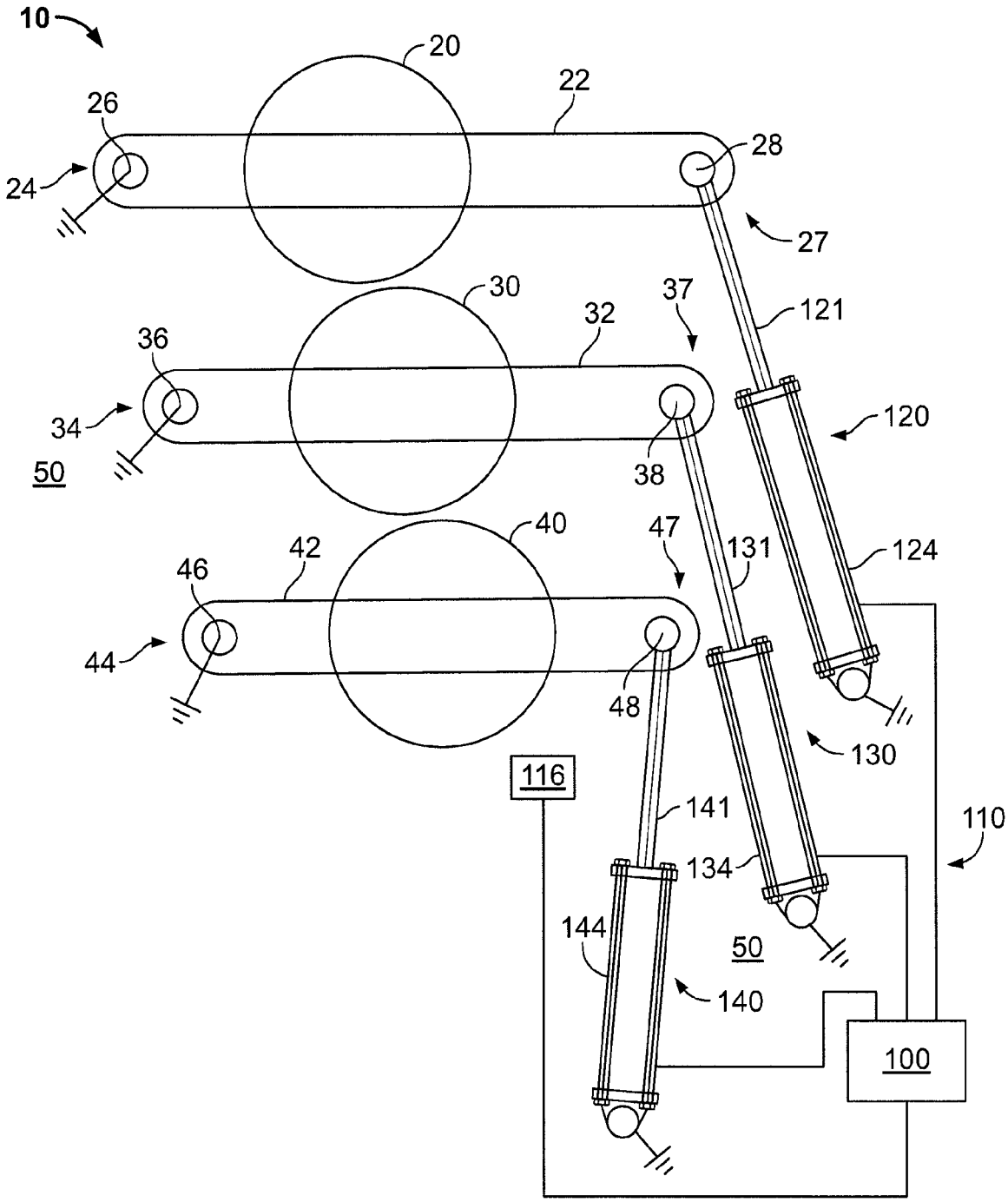
FIG. 1 shows schematically a variable-format printing press of a first embodiment using servo-hydraulic actuators to position the cylinders of the printing press.

FIG. 1 shows schematically a variable-format printing press 10 having a plate cylinder 20, a blanket cylinder 30 and an impression cylinder 40. Plate cylinder 20 is supported by a plate cylinder support 22 fixed at one end 24 via a pivot 26 to a frame 50 of the printing press 10, shown schematically. Plate cylinder support 22 at another end 27 is fixed via a pivot 28 to a plate cylinder actuator 120.

Blanket cylinder 30 is supported by a blanket cylinder support 32 fixed at one end 34 via a pivot 36 to frame 50. Blanket cylinder support 32 at another end 37 is fixed via a pivot 38 to a blanket cylinder actuator 130.

While, the impression cylinder 40 may be fixed to rotate in frame 50, in the preferred embodiment, impression cylinder 40 is also supported by an impression cylinder support 42 fixed at one end 44 via a pivot 46 to frame 50. Impression cylinder support 42 at another end 47 is fixed via a pivot 48 to an impression cylinder actuator 140. Similarly, it is possible to provide plate cylinder 20 in a fixed rotational support and to have only blanket cylinder support 32 and impression cylinder support 42 movable by actuators 130, 140.

Advantageously, actuators 120, 130, 140 may be servoactuators, and have integral linear position feedback. Thus actuators 120, 130, 140, unlike the prior art U.S. Pat. No. 6,694,877 actuators, have integral feedback capabilities, and can respond to a setpoint signal sent for example by a controller 100 via a communications line 110, for example an Ethernet, SERCOS or PROFIBUS link, to each servoactuator 120, 130, 140. Actuators 120, 130, 140 may be for example hydraulic servoactuators and may include respective hydraulic cylindrical rods 121, 131, 141 movable within respective housings 124, 134, 144. Feedback advantageously thus occurs directly within the servoactuator in respective housings 124, 134, 144 and may be based on direct measurement of the respective hydraulic cylinder rod 121, 131, 141. Mechanical ball screw actuators on the other hand infer position from a pitch of the screw and contains any error associated with the screw.

Controller 100 may be for example a microcomputer or ASIC, and may include a memory device for storing different setpoints for various sized cylinders and printing substrate materials. Controller 100 can send the setpoint once to the servoactuators 120, 130, 140 during an initalization, or can send the setpoint continually during the printing operation. Adjustment of the setpoints, for example based on predetermined tables or operator inputs, thus can occur during printing. For example, as a temperature in the press area during printing changes, automatic setpoint adjust could occur based on predetermined tables that indicate, for example, that the plate and blanket cylinders should be slightly moved apart a specific distance given a temperature rise that slightly expands the cylinder diameter. A temperature sensor 116 feeding an input to the controller 100 is thus provided, for example. In addition or alternative to adjusting the setpoints based on temperature, the setpoints for example may also be adjusted based on mechanical vibrations, wear of printing press components and/or humidity fluctuations measured by corresponding sensors within the press area.

Figure 2:
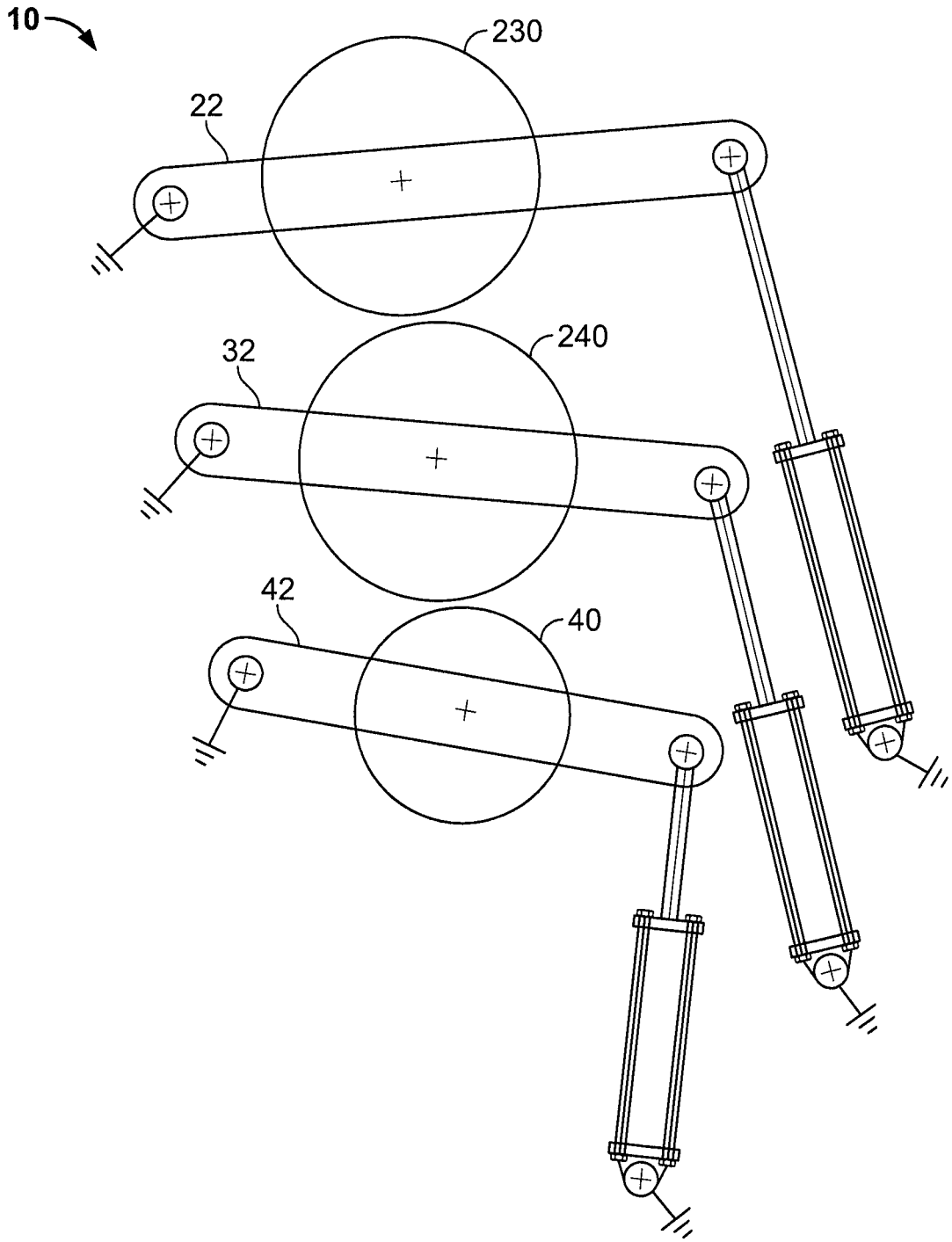
FIG. 2 shows schematically the printing press of FIG. 1 with larger diameter plate and blanket cylinders.

FIG. 2 shows the printing press 10 with a larger diameter plate cylinder 230 and a larger diameter blanket cylinder 240 replacing plate cylinder 30 and blanket cylinder 40, respectively. Such variable format cylinders can be provided in any known manner, such as replacement of the entire cylinder, or via a variable sized shell on a core of the cylinders.

Servoactuators 120, 130 are thus provided with different setpoints that are a function of the increased diameter of blanket cylinder 240 and plate cylinder 230 and adjust plate cylinder support 22 and blanket cylinder support 32 accordingly.

Figure 3:
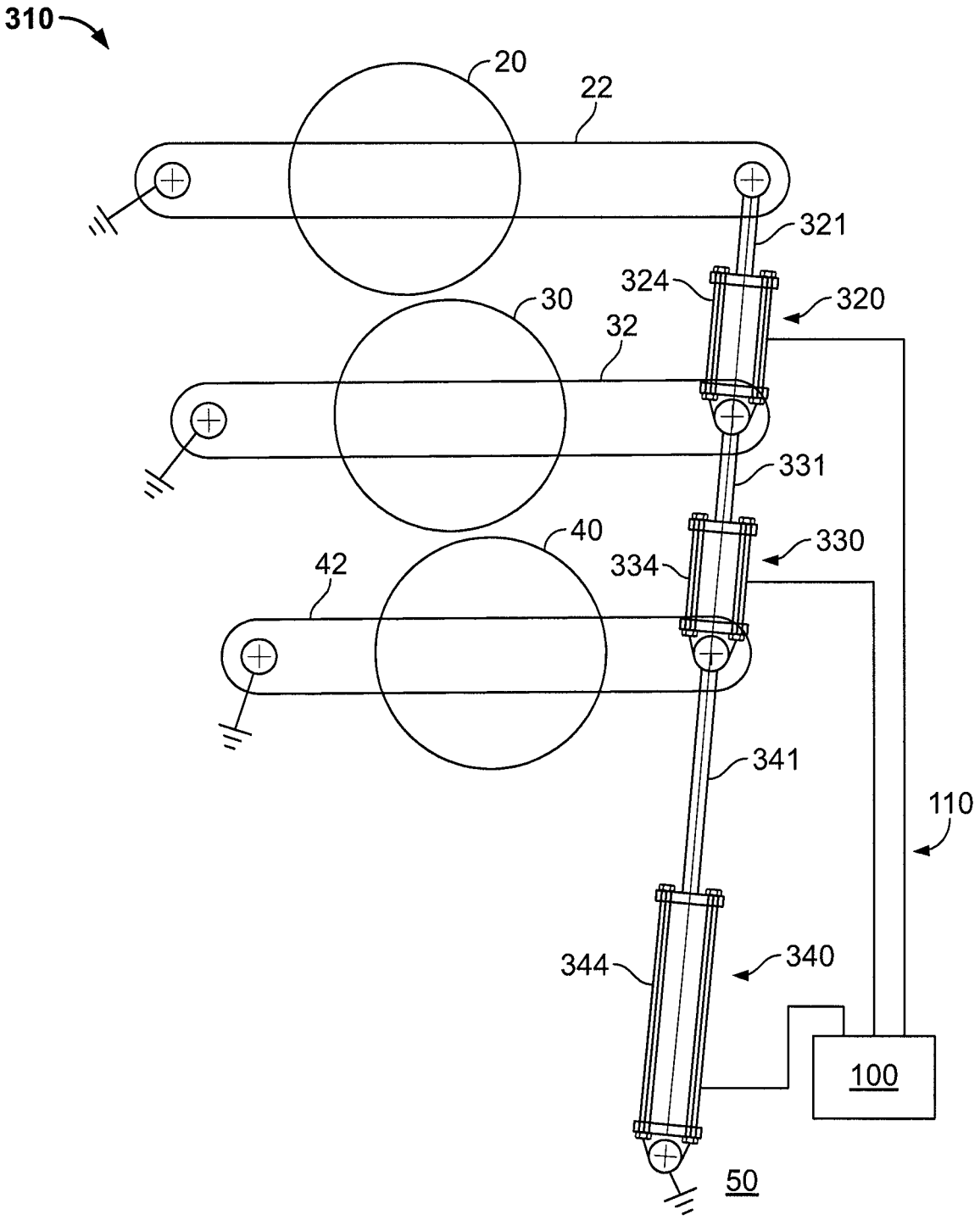
FIG. 3 shows a second embodiment of the printing press of the present invention.

FIG. 3 shows an alternate embodiment printing press 310 with a hydraulic servoactuator 320 between the plate cylinder support 22 and the blanket cylinder support 32, and a further servoactuator 330 between the blanket cylinder support 32 and the impression cylinder support 42. A further optional servoactuator 340 may be provided to move all supports 22, 32, 42 together. Servoactuators include respective hydraulic cylindrical rods 321, 331, 341 movable within respective housings 324, 334, 344. In this embodiment, rod 321 is coupled to plate cylinder support 22 while housing 324 is coupled to blanket cylinder support 32. Similarly, rod 331 is coupled to blanket cylinder support 32 while housing 334 is coupled to impression cylinder support 42. Rod 341 of actuator 340 is coupled to impression cylinder support 42 and housing 344 is coupled to frame 50. In this embodiment, a single actuator may control squeeze between two cylinders, for example servoactuator 320 may control the squeeze between cylinders 20, 30 and servoactuator may control the squeeze between cylinders 30, 40. Controller 100 via communications line 110 for example send the setpoint signals for servoactuators 320, 330, 340. Servoactuators 320, 330, 340 may be for example hydraulic servoactuators.

Figure 4:
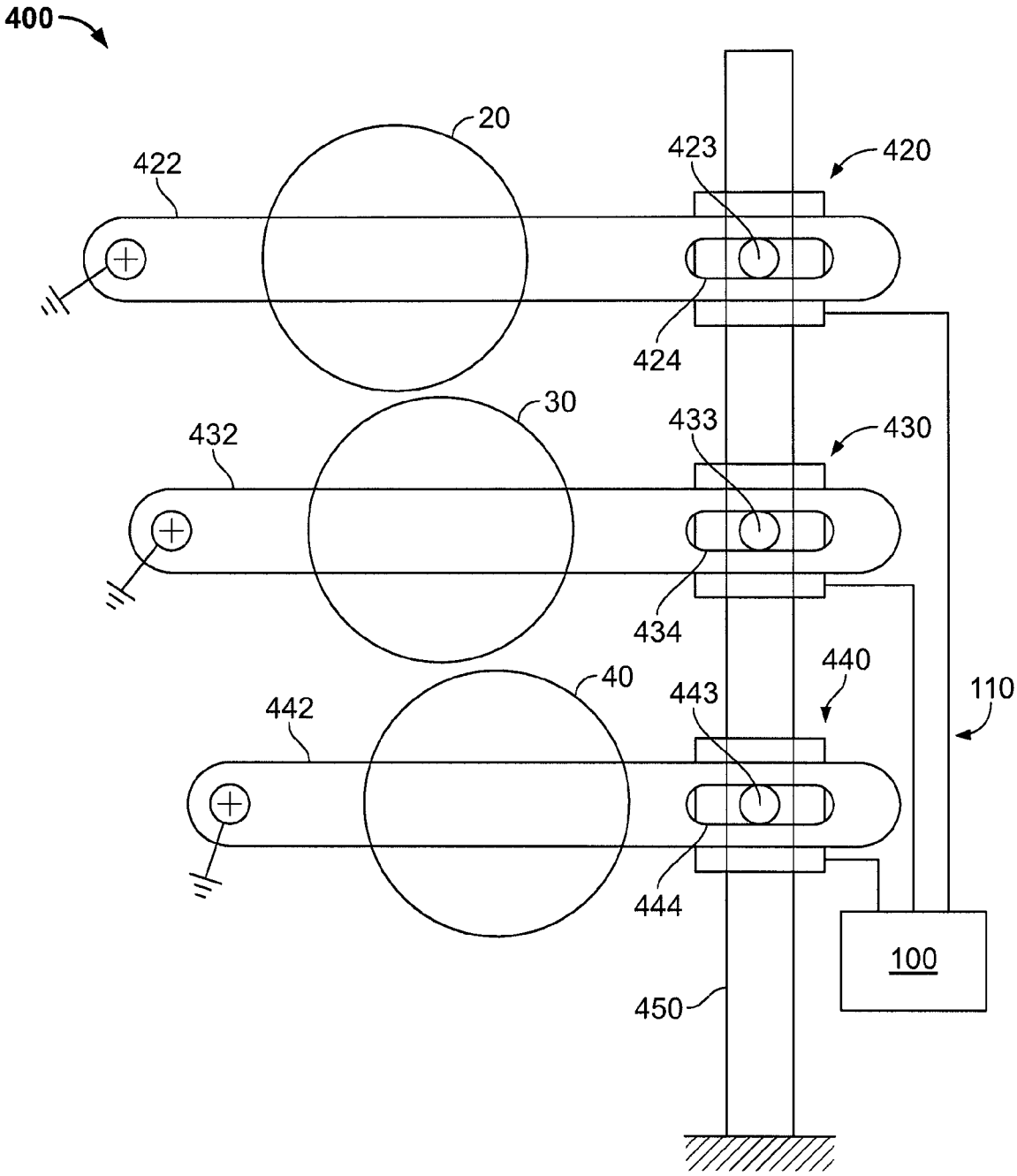
FIG. 4 shows a third embodiment of the printing press of the present invention.

FIG. 4 shows a further alternate embodiment printing press 400, with a carriage rail 450 fixed to the frame 50. Individual linear servomotors 420, 430, 440 provide independent positioning of a plate cylinder support 422, a blanket cylinder support 432 and, optionally, an impression cylinder support 442. Each of the supports 422, 432, 442 may have a respective slot 424, 434, 444 at one end interacting with a pin 423, 433, 443, respectively, fixed to individual linear servomotors 420, 430, 440, respectively. Linear servomotors 420, 430, 440 may for example have a carriage riding on rail 450 with position feedback being a direct result of the position of the respective motor 420, 430, 440 on rail 450, which may be measured within the respective motor 420, 430, 440. Controller 100 via communications line 110 for example send the setpoint signals for the servomotors 420, 430, 440. Servomotors 420, 430, 440 may be for example linear servomotors.

Figure 5:
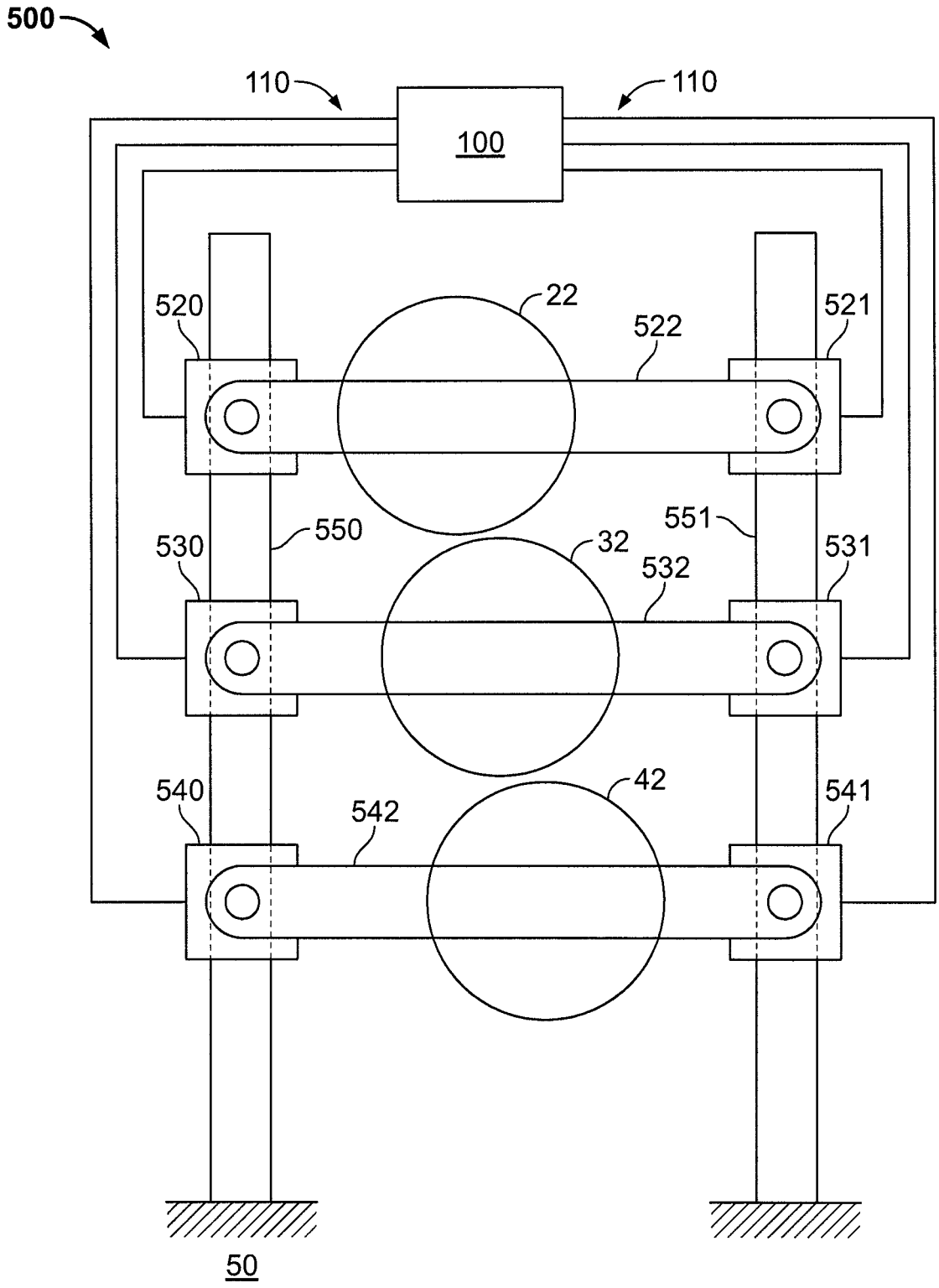
FIG. 5 shows a fourth embodiment of the printing press of the present invention.

FIG. 5 shows yet a further embodiment printing press 500 in which linear servomotors 520, 521 support plate cylinder support 522 via rails 550, 551 fixed to frame 50. Likewise, servomotors 530, 531 support blanket cylinder support 532, and servomotors 540, 541 impression cylinder support 542. Controller 100 via communications line 110 for example send the setpoint signals for the servomotors 520, 521, 530, 531, 540, 541. Servomotors 520, 521, 530, 531, 540, 541 may be for example linear servomotors.

While one of the movable supports for the three cylinders is optional (for example the impression cylinder support as described above with respect to certain embodiments), such as the impression cylinder support, preferably all three supports are movable and controllable by a servomotor during operation for more accurate control.

It is also noted that double sided print units may also be provided in which the impression cylinder is a blanket cylinder, and a further lower plate cylinder is provided.

The present invention permits easy and quick movement of cylinders, while permitting proper control during actual printing operations. In addition to integrated position feedback control at the servomotors, it is also possible to provide velocity and acceleration controls if more accurate control is desired.

In the preceding specification, the invention has been described with reference to specific exemplary embodiments and examples thereof. It will, however, be evident that various modifications and changes may be made thereto without departing from the broader spirit and scope of invention as set forth in the claims that follow. The specification and drawings are accordingly to be regarded in an illustrative manner rather than a restrictive sense.

What is claimed is:

1. A printing press comprising:

a frame;

a plate cylinder;

a plate cylinder support supporting the plate cylinder;

a blanket cylinder for receiving an image from the plate cylinder;

a blanket cylinder support supporting the blanket cylinder;

an impression cylinder for supporting a printing substrate between the blanket cylinder and the impression cylinder;

a first actuator connected to and controlling a position of the plate cylinder support;

a second actuator connected to and controlling a position of the blanket cylinder support; and a controller providing the first actuator with a first position setpoint and the second actuator with a second position setpoint, the first actuator receiving first position feedback signals to maintain the first position setpoint during a printing operation, the second actuator receiving second position feedback signals to maintain the second position setpoint during the printing operation.

2. The printing press as recited in claim 1 wherein the at least one of the first and second actuators is a servoactuator.

3. The printing press as recited in claim 1 wherein at least one of the first position feedback is measured directly within the first actuator and the second position feedback is measured directly within the second actuator.

4. The printing press as recited in claim 1 wherein the first and second actuators are hydraulic servoactuators or linear servomotors.

5. The printing press as recited in claim 1 wherein the first actuator is between and coupled to the blanket cylinder support and the plate cylinder support.

6. The printing press as recited in claim 1 further comprising a rail coupled to the frame, the at least one of the first and second actuators sliding along the rail to control the position of at least one of the plate cylinder support and the blanket cylinder support.

7. The printing press as recited in claim 1 wherein the printing press is a variable format printing press.

8. The printing press as recited in claim 7 wherein the first position setpoint corresponds to a first plate cylinder diameter and the second position setpoint corresponds to a second plate cylinder diameter.

9. The printing press as recited in claim 1 wherein at least one of the first and second actuators compensates for variations or changes during the printing operation.

10. The printing press as recited in claim 9 wherein the variations or changes include one or more of mechanical vibrations, temperature fluctuations and humidity fluctuations.

11. The printing press as recited in claim 9 wherein the variations include wear over time from normal printing operation.

12. The printing press as recited in claim 1 further comprising an impression cylinder support supporting the impression cylinder and a third actuator connected to and controlling a position of the impression cylinder support, the controller providing the third actuator with a third position setpoint, the third actuator receiving third position feedback signals to maintain the third position setpoint during a printing operation.

13. A method for operating a printing press comprising:

setting a position of a plate cylinder in a printing press via a first actuator to a plate cylinder position setpoint and setting a position of a blanket cylinder in the printing press via a second actuator to a blanket cylinder position setpoint;

receiving position feedback information; and actively controlling the first and second actuators during a printing operation to maintain the plate cylinder position setpoint and the blanket cylinder position setpoint.

14. The method as recited in claim 13 further comprising altering a diameter of the plate cylinder and sending a further plate cylinder setpoint, the further plate cylinder setpoint being a function of the altered diameter.

15. The method as recited in claim 13 wherein the actively controlling step includes actively controlling the first actuator during a printing operation as a function of the position feedback information and the plate cylinder position setpoint and actively controlling the second actuator during a printing operation as a function of the position feedback information and the blanket cylinder position setpoint.

16. The method as recited in claim 13 wherein the actively controlling step includes sensing at least one characteristic within an area of the printing press.

17. The method as recited in claim 16 wherein the actively controlling step further includes actively controlling the first actuator during a printing operation as a function of the position feedback, the plate cylinder position setpoint and the at least one characteristic and actively controlling the second actuator during a printing operation as a function of the position feedback information, the blanket cylinder position setpoint and the at least one characteristic.

18. The method as recited in claim 17 wherein the at least one characteristic is at least one of temperature, mechanical vibrations, wear of printing press components and humidity.

19. The method for operating a printing press as recited in claim 13 further comprising the step of:

adjusting the plate cylinder position setpoint and the blanket cylinder position setpoint during printing.

20. The method as recited in claim 13 further comprising setting a position of an impression cylinder in the printing press via a third actuator to an impression cylinder position setpoint and actively controlling the third actuator during a printing operation to maintain the impression cylinder position setpoint.

* * * * *